United States Patent [19]

Krikheli

[11] Patent Number: 4,836,547

[45] Date of Patent: Jun. 6, 1989

[54] GAME ARTICLE

[76] Inventor: Zurab Krikheli, 99-05 63 Dr., Rego Park, N.Y. 11374

[21] Appl. No.: 246,220

[22] Filed: Sep. 19, 1988

[51] Int. Cl.[4] ..... A63F 9/08
[52] U.S. Cl. ..... 273/153 S
[58] Field of Search ..... 273/153 S

[56] References Cited

U.S. PATENT DOCUMENTS 4,553,754 11/1985 Wiggs et al. ..... 273/153 S
4,735,417 4/1988 Gould ..... 273/153 S

FOREIGN PATENT DOCUMENTS 54886 6/1982 European Pat. Off. ..... 273/153 S
WO82/00101 1/1982 World Int. Prop. O. ..... 273/153 S

*Primary Examiner*—Anton O. Oechsle
*Attorney, Agent, or Firm*—Ilya Zborovsky

[57] ABSTRACT

A game article has a central spherical main body with a plurality of grooves which form a plurality of lands therebetween, a plurality of auxiliary members radially spaced from the main body, and a plurality of carriers each supporting a respective auxiliary member and having a guiding portion guidingly movable in the groove and a supporting portion which supports the auxiliary member.

16 Claims, 4 Drawing Sheets

GAME ARTICLE

BACKGROUND OF THE INVENTION

The present invention relates to game articles in general. More particularly, it relates to a game article which has a plurality of movable elements which upon being moved by a user assume a certain desired orientation.

Game articles of the above mentioned general type are known in the art. One of the articles of this type is a RUBIK'S CUBE ® which has a plurality of turnable elements arranged so that upon actuation by a user they can assume a desired orientation, for example all sides of the same color for sub-cubes of each side. While this game article is very popular, its playing capability is limited to a certain degree. Thus, it is desirable to provide other articles of this type, with different playing capabilities.

SUMMARY OF THE INVENTION

Accordingly, it is an object of the present invention to provide a game article which avoids the disadvantages of the prior art, and has high playing capability and attraction to players.

In keeping with these objects and with others which will become apparent hereinafter, one feature of the present invention resides, briefly stated, in a game article which has a main body with a spherical outer surface provided with a plurality of guiding grooves which are separated from each other by lands, a plurality of auxiliary members arranged to be radially spaced from the spherical surface, and a plurality of carriers which are guidingly movable in the grooves and carry the auxiliary members to move them around the main body so as to assume a certain desired orientation relative to a respective land. For example, upon movement by a user, the auxiliary members can surround a respective land. Then they can be moved to surround a different land, etc.

The novel features of the present invention are set forth in particular in the appended claims. The invention itself, however, will be best understood from the following description of preferred embodiments which is accompanied by the following drawings.

DESCRIPTION OF PREFERRED EMBODIMENTS

Figure 2:
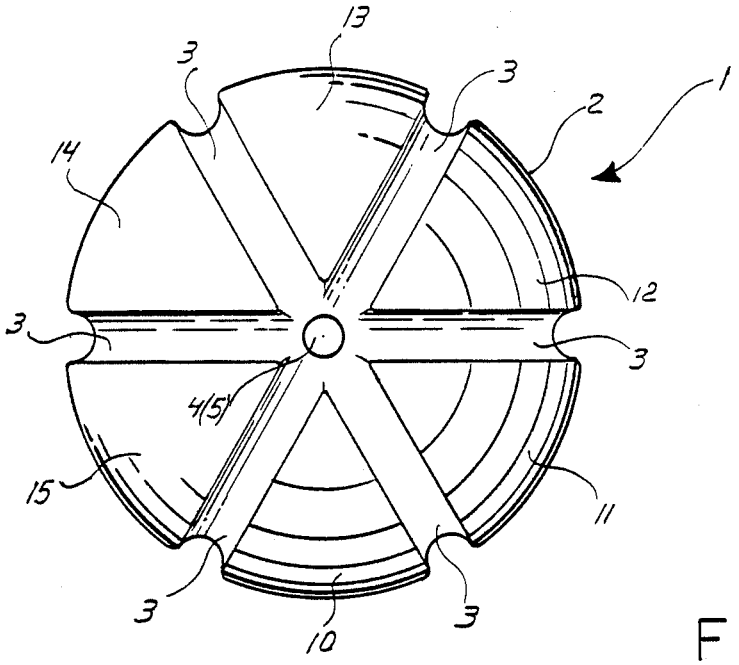
FIG. 2 is a plan view of the main body shown in FIG. 1.
Figure 1:
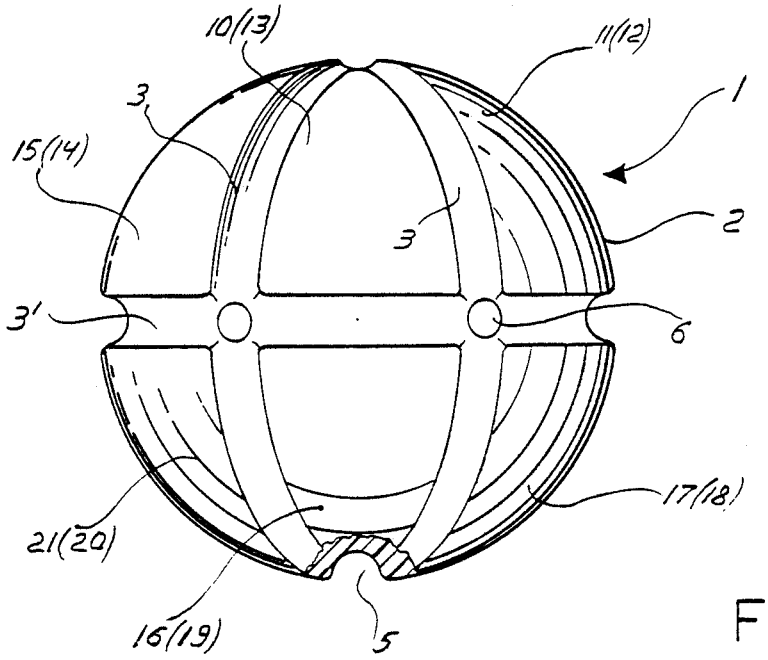
FIG. 1 is a side view of a main body of the inventive game article.

A game article in accordance with the present invention has a central main body which is spherical as shown in FIGS. 1 and 2 and identified with reference numeral 1. The main body has an outer spherical surface 2 which is provided with a plurality of groove-shaped guides or grooves which include six substantially vertical or meridian grooves 3 and one substantially horizontal or parallel groove 3'. The grooves 3 intersect each other in an upper depressed point 4 and a lower depressed point 5, and intersect the groove 3' in depressed points 6. The grooves 3 and 3' form therebetween six upper lands 10–15 and six lower lands 16–21 having convex surfaces.

The game article of the invention further has a plurality of auxiliary members 22 formed for example as spherical members. With the main body 1 formed as shown in FIGS. 1 and 2, three auxiliary members 22 can be provided. Each auxiliary member 22 is mounted on a carrier 23. The carrier 23 has a supporting portion 24 which directly supports the auxiliary member 22, and a guiding portion which is connected with the supporting portion and is to be guided in a respective groove of the main body. The guiding portion is identified with reference numeral 25 and can be wireshaped. The carrier 23 or more particularly its guiding portion 25 extends over an angle of more than 180°, preferably over 270° so as to embrace more than half the diameter of the main body and to be retained thereby on the latter.

The guiding portion 25 can be elastically yieldable for example composed of an elastic and springy plastic, so that it can be spread by a user and fitted onto the main body into the respective groove to firmly snap on the main body with a movable fit. The supporting portion 24 of the carrier has two supporting legs which are spaced from one another to define a gap 26 therebetween. This gap is slightly wider than the diameter of the guiding portion 25 so that the guiding portion 25 of one carrier can pass through the gap 26 between the legs of the supporting portion of another carrier.

Figure 3:
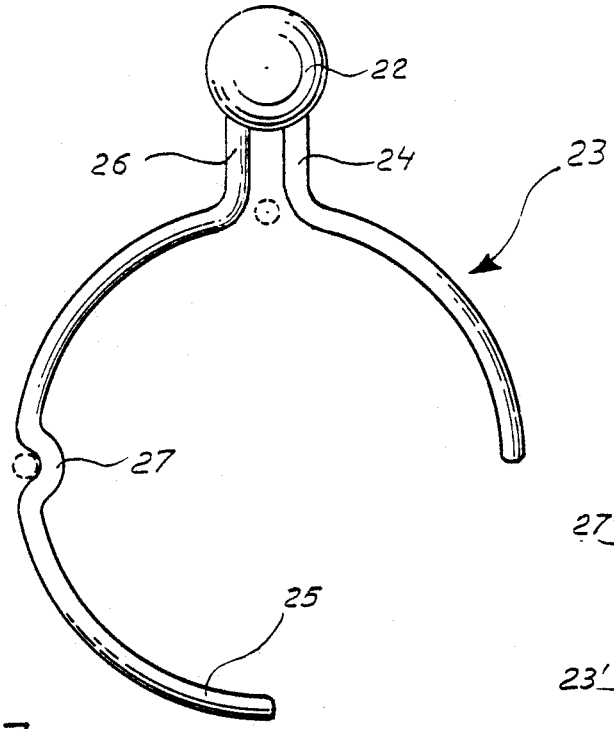
FIG. 3 is a side view of a carrier with an auxiliary member of the inventive game article.

The guiding portion 25 of each carrier 23 has a depression 27 which is shaped so that it is somewhat complementary to and can engage in respective depressed points 4–9 of the main body so as to arrest temporarily the respective carrier and therefore the respective member in a desired position by means of the interengagement of the depression in the depressed point. The guiding portion 25 is curved with a radius substantially corresponding to the radius of the guiding grooves. Each guiding portion has a shorter curved leg connected with one leg of the supporting portion 24, and a longer curved leg connected with another leg of the same supporting portion. The outer concavity of each depression 27 of the guiding portion is formed so as to allow passage of a remaining curved portion of the guiding portion of another carrier, as shown in dotted line at the left in FIG. 3.

When the carriers are firmly seated on the main body, only the remaining curved wire portion of one carier can pass in the concavity of the depression of the guiding portion of another carrier. The depression of one carrier cannot pass over the depression of another carrier, since for this purpose the one carrier must be radially lifted from the groove of the body which is not possible with firm hold of the carriers on the body.

Figure 6:
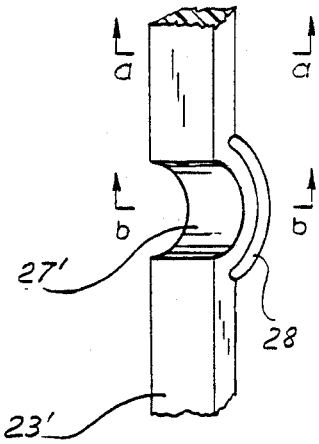
FIG. 6 shows another modification of the carrier for the auxiliary member withtwo cross sections A-A and B-B.
Figure 4:
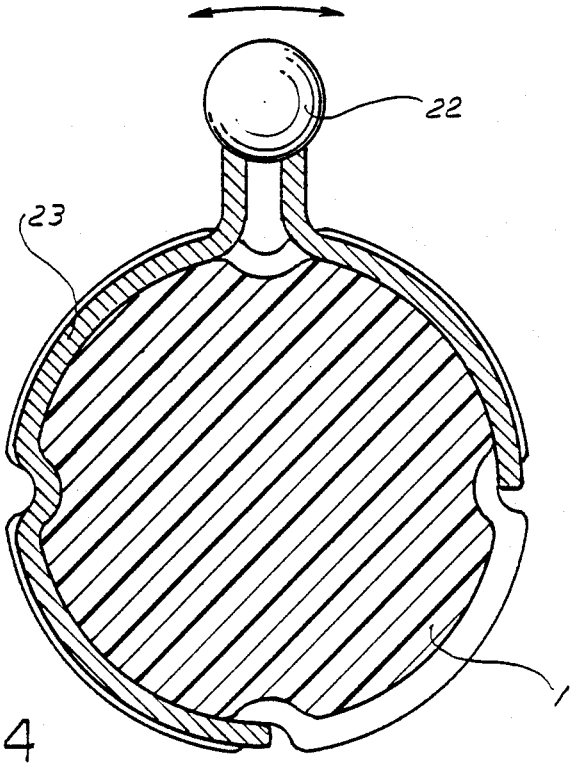
FIG. 4 is a view showing the inventive game article in an assembled condition, in one position of the auxiliary member.
Figure 6A:
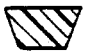
FIGS. 6A and 6B show cross-sectional views of the carrier taken along section lines A-A and B-B, respectively, of FIG. 6.
Figure 6B:
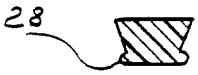

FIG. 6 shows an additional feature for insuring that the depressions of the carriers cannot pass over one another. Here a depression 27' of a carrier 23' has a transverse projection 28 which does not permit the above mentioned passage. Moreover, the carrier 23' is formed here not as a wire, but instead as a strip having a predetermined width and a wedge-shaped cross section.

The auxiliary members 22 can be formed as spheres with a diameter which is smaller than the diameter of the main body 1. They of course can have different shapes as well. The auxiliary member can be connected to the supporting portion of the carrier for example by soldering, welding, gluing etc. The auxiliary member can have different characteristics, for example shapes, colors, images on them, etc. It is desirable when one auxiliary member and its carrier have the same characteristic, for example the same color, which is different from the colors of other auxiliary members with the carriers.

The lands 10–21 can have different characteristics, for example different shapes or outer convex surfaces, different colors, different images on their outer surfaces, etc.

Figure 5A:
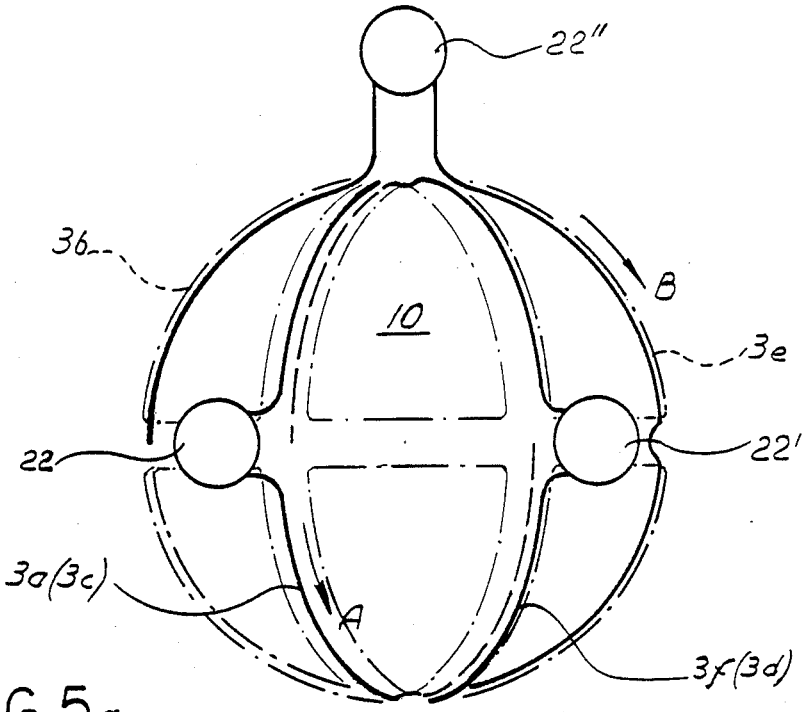
FIGS. 5A and 5B illustrates two different positions of the auxiliary members.
Figure 5B:
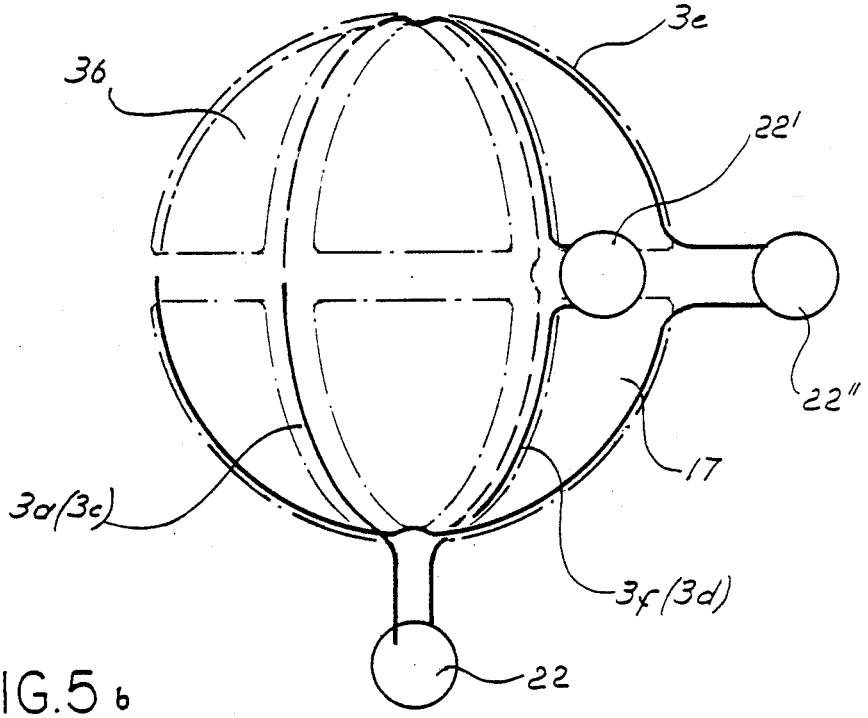

The game article can be played with for example by displacing the auxiliary members so as to surround a desired land. In FIG. 5*a* the land 10 is surrounded by three auxiliary members 22, 22' and 22". The guiding portions of these auxiliary members are located in the respective grooves. More particularly, the short leg of the guiding portion of the member 22 is located in the upper part of the groove 3*a*, one half of the long leg of the guiding portion of the member 22 is located in the lower part of the groove 3*a*, the other half of the long leg of the guiding portion of the member 22 is located in the lower part of the groove 3*d*. The short leg of the guiding portion of the member 22' is located in the lower part of the groove 3*f*, one half of the long leg of the guiding portion of the member 22' is located in the upper part of the groove 3*c*, the other half of the long leg of the guiding portion of the member 22' is located in the upper part of the groove 3*c*. The short leg of the guiding portion of the member 22" is located in the upper part of the groove 3*b*, while the two halves of the long leg of the same are located in the upper and lower parts of the groove 3*e*.

Assuming that now a user set a goal to surround the land 17, the members must be moved to respective new positions. More particularly, the member 22 is moved in direction of the arrow A downwardly by one step, or in other word by one half of the height of the main body. As a result, the short leg of the guiding portion of the member 22 will be located in the lower part of the groove 3*a*, while two halves of the long leg of the guiding portion of the member 22 will be located in the lower and upper parts of the groove 3*d*. The member 22" is also moved downwardly (B) by one step. As a result, the short leg of the guiding portion of the member 22" will be located in the upper part of the groove 3*e*, while two halves of the long leg of the guiding portion of the member 22" are located in the lower parts of the grooves 3*e* and 3*b*. The member 22' remains in its initial position. As a result of the above movement, the land 17 will be surrounded by the members 22, 22', 22". The movement of the respective guiding portion are not possible when the depression 27 of one guiding portion has to move over the depression 27 of the other guiding portion. Thus the movement must avoid such situations.

Figure 7:
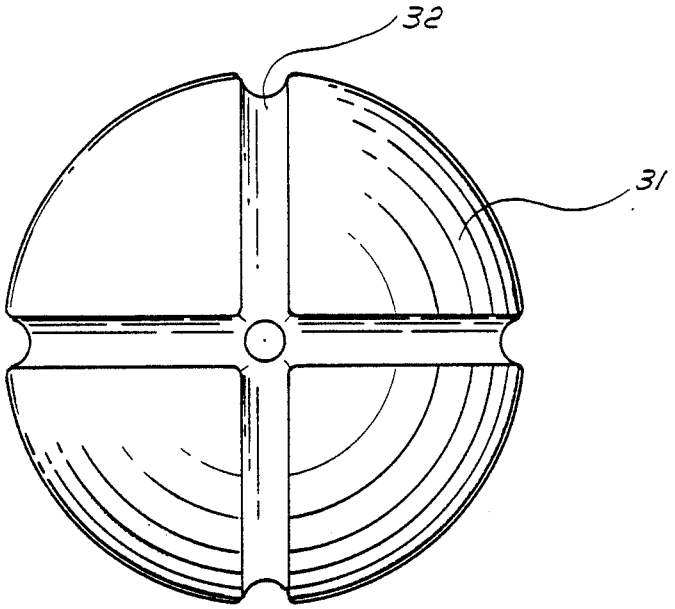
FIGS. 7 and 8 show further modifications of the main body of the inventive game article.
Figure 8:
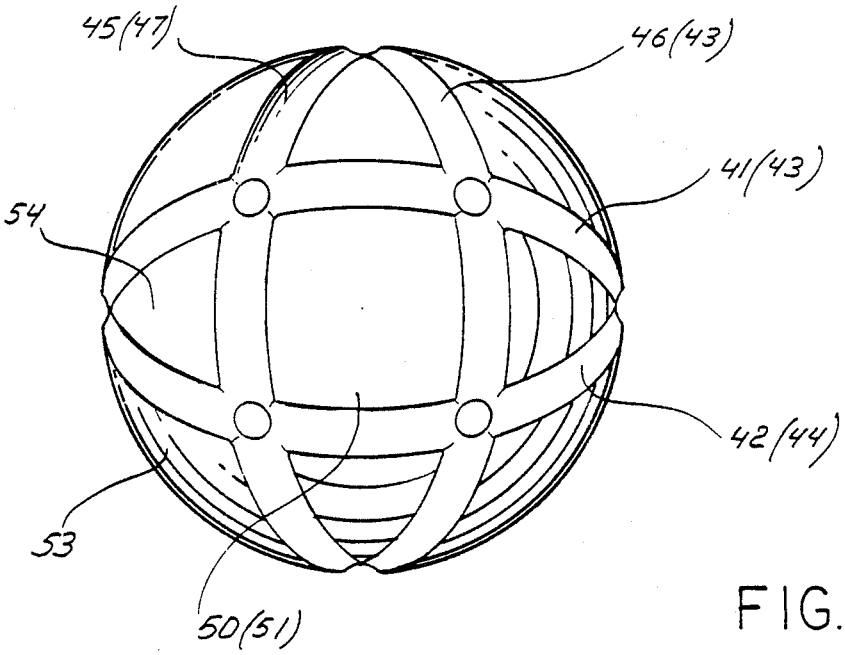

FIG. 7 shows a plan view of another main body which has four upper lands and four lower lands 31 produced by four substantially vertical or meridian grooves 32 and a not shown horizontal or parallel groove. FIG. 8 shows a further main body which has a plurality of lands formed by a plurality of groves which include for parallel grooves 41, 42, 43, 44 arranged so that the pair of grooves 41,42 and 43,44 form lens-shaped structures therebetween, and four meridian grooves 45, 46, 47, 48 arranged so that the pairs of grooves 45,46 and 47,48 also define therebetween the lens-shaped structures. As a result, the spherical surface of the main body has two square lands 50 and 51, a plurality of rhomb-shaped lands 53, and a plurality of triangular lands 54. It is to be understood that the main bodies with the lands of other shapes are also possible.

The present invention is not limited to the details shown since various modifications and structural changes are possible without departing in any way from the spirit of the invention.

What is desired to be protected by Letters Patent is set forth in the appended claims.

1. A game article, comprising a spherical main body having a spherical outer surface, a plurality of groove-shaped guides on said spherical surface, and a plurality of lands formed between said guides, a plurality of auxiliary members arranged to be radially spaced from said peripheral surface of said body and located around the latter; and a plurality of carriers each carrying a respective one of said auxiliary members and movable in said groove-shaped guides so as to move said auxiliary members over said spherical surface in spaced relationship therewith to assume a desired position relative to a respective one of said lands, each of said carriers having guiding portion formed to move in a respective one of said groove-shaped guides and a radially extending supporting portion connected with said guiding portion and directly carrying a respective one of said auxiliary members, said supporting portion including two legs which are spaced from one another to form a gap therebetween such that said guiding portion of one of said carriers can pass through the gap between said legs of another of said carriers.

2. A game article, comprising a spherical main body having a spherical outer surface, a plurality of groove-shaped guides on said spherical surface, and a plurality of lands formed between said guides; a plurality of auxiliary members arranged to be radially spaced from said peripheral surface of said body and located around the latter; and a plurality of carriers each carrying a respective one of said auxiliary members and movable in said groove-shaped guides so to move said auxiliary members over said spherical surface in spaced relationship therewith to assume a desired position relative to a respective one of said lands, each of said carriers having a curved guiding portion extending over an angle which exceeds 180° and formed to move in a respective one of said groove-shaped guides and a radially extending supporting portion connected with said guiding portion and directly carrying a respective one of said auxiliary members.

3. A game article, comprising a spherical main body having a spherical outer surface, a plurality of groove-shaped guides on said spherical surface, and a plurality of lands formed between said guides; a plurality of auxiliary members arranged to be radially spaced from said peripheral surface of said body and located around the latter; and a plurality of carriers formed as thin wire-like elements, each carrying a respective one of said auxiliary members and movable in said groove-shaped guides so as to move said auxiliary members over said peripheral surface in spaced relationship therewith.

4. A game article, comprising a spherical main body having a spherical outer surface, a plurality of groove-shaped guides on said spherical surface, and a plurality of lands formed between said guides; a plurality of auxiliary members arranged to be radially spaced from said peripheral surface of said body and located around the latter; and a plurality of carriers each carrying a respective one of said auxiliary members and movable in said groove-shaped guides so as to move said auxiliary members over said peripheral surface in spaced relationship therewith to assume a desired positon relative to a respective one of said lands, each of said carriers having a curved guiding portion formed to move in a respective one of said groove-shaped guides and a radially extending supporting portion connected with said guiding portion and directly carrying a respective one of said auxiliary members, said curved guiding portion of each of said carriers being elastically yieldable so that it can be spread to fit onto said main body and then snaps on said main body to be retained on the latter in a respective one of said groove-shaped guides with a movable fit.

5. A game article, comprising a spherical body having a spherical outer surface, a plurality of groove-shaped guides on said spherical surface, and a plurality of lands formed between said guides; a plurality of auxiliary members arranged to be radially spaced from said peripheral surface of said main body; and a plurality of carriers each carrying a respective one of said auxiliary members and movable in said groove-shaped guides so as to move said auxiliary members over said peripheral surface in spaced relationship therewith to assume a desired position relative to a respective one of said lands, each of said carriers having a curved guiding portion formed to move in a respective one of said groove-shaped guides and a radially extending supporting portion connected with said guiding portion and directly carrying a respective one of said auxiliary members, said groove-shaped guides intersecting each other in depressed intersection points, each of said guiding portions having a local depression arranged to engage in a respective one of said depressed points during movement of a respective one of said carriers so as to arrest temporarily the latter in a respective position.

6. A game article as defined in claim 3, wherein each of said carriers has a curved guiding portion formed to move in a respective one of said groove-shaped guides, and a radially extending supporting portion connected with said guiding portion and directly carrying a respective one of said auxiliary members.

7. A game article as defined in claim 1, wherein said guiding portion includes two curved legs each connected with a respective one of said legs of said supporting portion of each of said carriers.

8. A game article as defined in claim 7, wherein one of said curved legs is longer than the other of said curved legs of each of said guiding portions of said carriers.

9. A game article as defined in claim 3, wherein each of said auxiliary members is formed as a spherical member with a diameter which is smaller than a diameter of said main body.

10. A game article as defined in claim 1, wherein said carriers are formed as elongated striplike elements.

11. A game article as defined in claim 5, wherein said depressions are formed so that a depression of one carrier cannot pass over a depression of another carrier, while a remaining part of said guiding portion of the one carrier can pass over the same.

12. A game article as defined in claim 3, wherein at least some of said lands of said main body are provided with different images.

13. A game article as defined in claim 3, wherein said auxiliary members have different characteristics so that they are distinguishable from one another.

14. A game article as defined in claim 3, wherein said auxiliary members have different colors.

15. A game article as defined in claim 3, wherein each of said auxiliary members and a respective one of said carriers have a single characteristic which is different from characteristics of other of said auxiliary members and carriers.

16. A game article as defined in claim 3, wherein each of said auxiliary members and a respective one of said carriers have a same color which is different from a color of other auxiliary members and carriers.

* * * * *